US008607900B1

(12) United States Patent
Smith

(10) Patent No.: US 8,607,900 B1
(45) Date of Patent: Dec. 17, 2013

(54) DOWNHOLE TOOL ENGAGING A TUBING STRING BETWEEN A DRILL BIT AND TUBULAR FOR REAMING A WELLBORE

(71) Applicant: LB Enterprises, LLC, Anchorage, AK (US)

(72) Inventor: Lee Morgan Smith, Anchorage, AK (US)

(73) Assignee: LB Enterprises, LLC, Anchorage, AK (US)

( * ) Notice: Subject to any disclaimer, the term of this patent is extended or adjusted under 35 U.S.C. 154(b) by 0 days.

(21) Appl. No.: 13/889,969

(22) Filed: May 8, 2013

Related U.S. Application Data

(60) Provisional application No. 61/693,459, filed on Aug. 27, 2012.

(51) Int. Cl.
*E21B 10/44* (2006.01)
*E21B 17/22* (2006.01)

(52) U.S. Cl.
USPC ..... 175/394; 175/401; 175/323; 175/406

(58) Field of Classification Search
USPC ..... 175/394, 401, 323, 406, 434, 325
See application file for complete search history.

(56) References Cited

U.S. PATENT DOCUMENTS 3,268,274 A * 8/1966 Ortloff et al. ..... 175/325.4
3,285,678 A * 11/1966 Garrett et al. ..... 175/325.2
3,420,323 A * 1/1969 Owens ..... 175/323
3,447,839 A * 6/1969 Salvatori ..... 175/325.4
3,933,395 A * 1/1976 Evans ..... 175/325.2
3,938,853 A * 2/1976 Jurgens et al. ..... 175/325.2
4,081,203 A * 3/1978 Fuller ..... 175/325.4
4,156,374 A * 5/1979 Shwayder ..... 76/108.2
4,231,437 A * 11/1980 Swersky et al. ..... 175/325.3
4,385,669 A * 5/1983 Knutsen ..... 175/323
4,610,316 A * 9/1986 Boaz ..... 175/323
4,664,206 A * 5/1987 Butler ..... 175/325.2
5,341,888 A * 8/1994 Deschutter ..... 175/323
6,349,779 B1 * 2/2002 Gilbert ..... 175/323
6,474,423 B1 * 11/2002 Wood ..... 175/323
7,650,952 B2 * 1/2010 Evans et al. ..... 175/61
8,162,081 B2 * 4/2012 Ballard et al. ..... 175/325.2
8,336,645 B2 * 12/2012 Robson et al. ..... 175/323
8,434,570 B2 * 5/2013 Boulet ..... 175/323
2008/0093076 A1 * 4/2008 Patil et al. ..... 166/298
2012/0255786 A1 10/2012 Isenhour

* cited by examiner

*Primary Examiner* — Kenneth L Thompson
(74) *Attorney, Agent, or Firm* — Buskop Law Group, PC; Wendy Buskop

(57) ABSTRACT

A downhole tool for bidirectional reaming of a wellbore with a tubular body with a central cutting section between a first end segment and a second end segment, wherein the central cutting section has a plurality of helical blades separated by flute sections, and wherein the helical blades each have at least two spiral angled sections connected together, polydiamond cutter nodes, high strength carbide cutting nodes, tungsten carbide hardfacing coating or combinations thereof on the helical blades, and wherein the outer diameter of the central cutting section is larger than the outer diameter of each of the end segments.

18 Claims, 4 Drawing Sheets

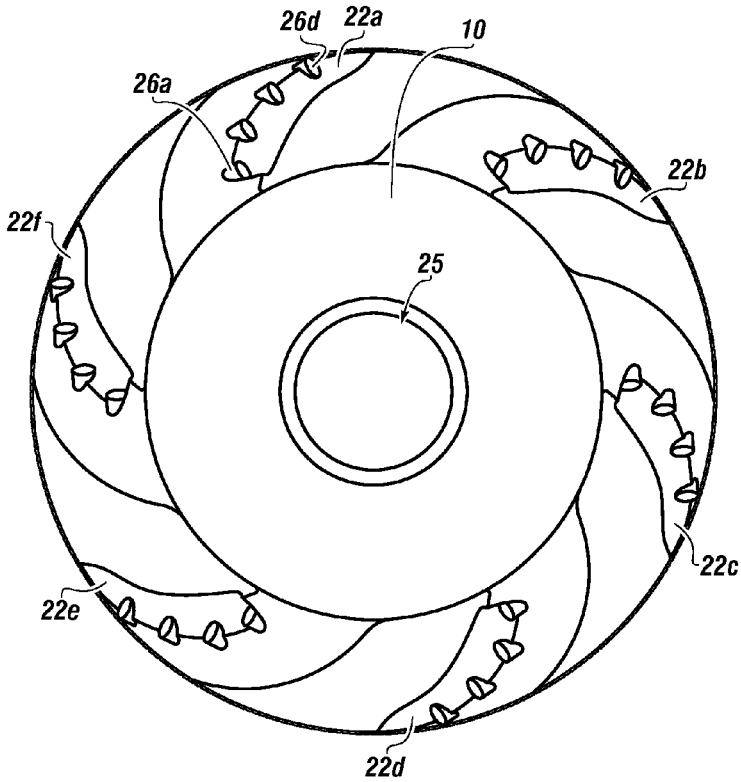
FIGURE 3
FIGURE 4
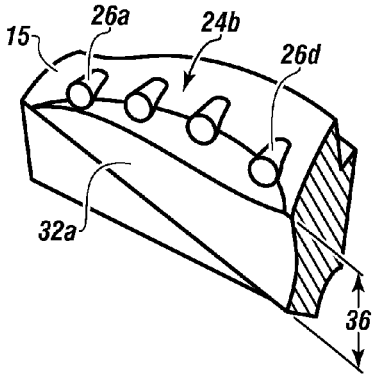
FIGURE 5
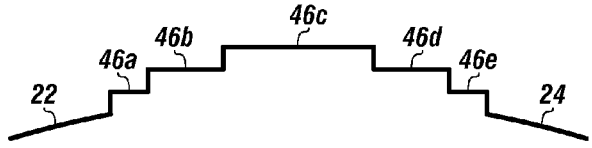

DOWNHOLE TOOL ENGAGING A TUBING STRING BETWEEN A DRILL BIT AND TUBULAR FOR REAMING A WELLBORE

CROSS REFERENCE TO RELATED APPLICATION

The current application claims priority and the benefit of co-pending U.S. Provisional Patent Application Ser. No. 61/693,459 filed on Aug. 27, 2012, entitled "DOWNHOLE TOOL FOR ENGAGING A TUBING STRING BETWEEN A DRILL BIT AND TUBULAR FOR REAMING A WELLBORE". This reference is incorporated herein in its entirety.

FIELD

The present embodiments generally relate to drilling devices used in core drilling of wellbores.

BACKGROUND

Prior art has disclosed using polycrystalline diamond compacts in reamers, but a need exists for the ability to ream both into and out of a wellbore with polydiamond compacts, high density cutters, or both on both sides of the reamer simultaneously.

The present embodiments relate to a reamer which is bidirectional and can additionally be used as a drill to create a wellbore.

Prior art has also disclosed reamers, but these reamers do not bidirectionally widen and smooth a wellbore. A need exists for a bidirectional reamer that can both widen and smooth a wellbore while being run into and out of a wellbore allowing for faster insertion and removal of bottom hole assemblies.

A need exists for a tool made of steel or a non-magnetic material that allows the tool to be used in directional drilling applications wherein a high degree of accuracy in drilling is required.

The present embodiments meet these needs.

BRIEF DESCRIPTION OF THE DRAWINGS

The detailed description will be better understood in conjunction with the accompanying drawings as follows:

FIG. 3 is a view from the first end of the tubular body of an embodiment of the downhole tool with the first spiral angled sections extending away from a longitudinal axis.

FIG. 4 is a detail of a second spiral angled section that extends away from a longitudinal axis of the tubular body additionally showing flute depth and a plurality of polydiamond cutter nodes.

FIG. 5 is a diagram of a stepped embodiment of the central cutting section of the downhole tool.

Figure 1:
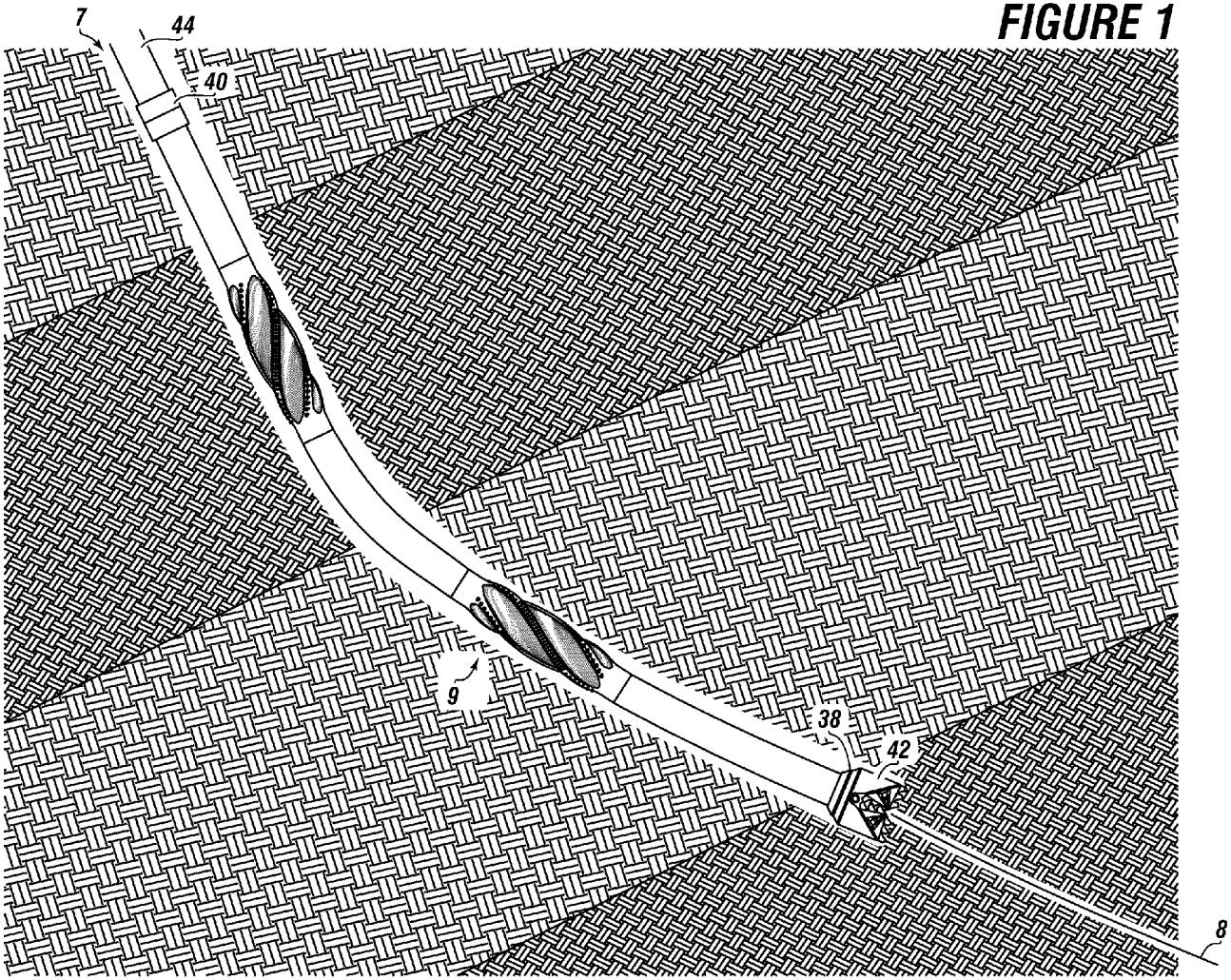
FIG. 1 is cross sectional view of an embodiment of a downhole tool in a wellbore.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it are practiced or carried out in various ways.

The present embodiments relate to drilling devices used in core drilling of wellbores. The present embodiments further relate to a reaming apparatus.

The reaming apparatus, in an embodiment, can use polycrystalline diamond compacts and helical blades to cut and smooth a wellbore while the device is attached to a drill string and is run into and out of a wellbore, reaming while drilling.

The downhole tool can ream a wellbore with a wellbore axis, in two directions while attached to a drill string, (i) into a wellbore and (ii) out of a wellbore as the drill string is inserted into the wellbore and pulled out of the wellbore. The tool can be attached between the drill bit and a tubular for use in the well.

The downhole tool can have a central annulus which can allow mud to be pumped through the tool and used for enhanced drilling.

An advantage of this downhole tool is that the downhole tool can be usable in 10,000 foot wells at depths including but not limited to 18,000 feet. In one or more embodiments, the downhole tool can be usable in wells with depths from 1,000 feet to 30,000 feet.

In one or more embodiments, the downhole tool can be usable with swell packers attached to a swell packer on one end as the swell packer is run into the wellbore.

Currently, operators are using from 20 to 40 plus swell packers or mechanical packers. These drilling operators need a very clean bore for accurate and precise well packer placement. The drilling operators can use this downhole tool to enable swell packers or mechanical packers to be placed at the precise position that they are needed in the wellbore. An advantage of the present downhole tool is that the downhole tool enables the creation of a very clean, smooth wellbore, with no large pieces of rock sticking out of the wellbore that would damage or cause misplacement of the swell packer.

Another advantage of the downhole tool is that the downhole tool is made up into the bottom hole assembly, replacing conventional stabilizers.

The downhole tool provides a less expensive solution to conventional stabilizers.

The downhole tool can perform drilling out of casing, simplifying drilling operations to a single trip instead of current technology that requires multiple trips. Since each trip into the well can cost about $250,000 per trip, only needing one trip for reaming the wellbore can save about $250,000 per reaming job over currently available single directional reamers.

The downhole tool provides smooth wellbores, which allow for faster drilling and faster packer installations.

An advantage of this downhole tool is that larger outer diameter swell packers can be usable in drilling, which can safely support high pressure in the well and provide a better frac job on a well.

The downhole tool can be usable to drill out through float equipment of a well.

The downhole tool can be usable to drill rock and ream the wellbore simultaneously.

The downhole tool can ream while drilling. The downhole tool can ream while operating measuring with drilling equipment.

In embodiments, the downhole tool for engaging a first bottom hole assembly component and a second bottom hole assembly component for use in a wellbore can have a tubular body with a central cutting section. The central cutting section can be made of a first end segment having a first end and a first end segment outer diameter; a second end segment having a second end and a second end segment outer diameter; and a central cutting section extending longitudinally along the tubular body between the first end segment and the second end segment and away from a longitudinal axis.

In an embodiment, the downhole tool can have a tubular body with a bulge, can also be referred to herein as the central cutting section.

The central cutting section can be formed extending from the tubular body between a first end segment with a first end and a second end segment with a second end.

The central cutting section can be formed between the ends and can have an outer diameter 2 percent to 15 percent larger than the outer diameter of the ends in some embodiments.

The downhole tool can have a central annulus allowing the flowing of drilling mud in one direction and well material in another direction.

In embodiments, the tubular body with a central cutting section can include a non-magnetic material, such as a non-magnetic steel, such as MONEL™.

The tubular body in embodiments can have a longitudinal axis extending from end to end. The downhole tool can rotate about the longitudinal axis to cut the rock. The central cutting section can bulge away from the longitudinal axis between the first end segment and the second end segment.

The downhole tool can have at least two helical blades formed between the end segments of the downhole tool. The end segments can have end segment diameters that are less than the diameter of the central cutting section, and the end segments can each be 1 percent to 10 percent the overall length of the tool. The end segments can be formed extending from each end of the tool.

In one or more embodiments, from 2 helical blades to 16 helical blades can be usable in the central cutting section. Each helical blade can have a length of 60 inches to 80 inches.

In embodiments, each helical blade can have a first spiral angled section increasing in radius from the first end segment towards a midpoint of the downhole tool. The midpoint can intersect at a right angle with the longitudinal axis.

Each helical blade can have a first spiral angled section extending away from the first end segment at an angle from about 1 degree to about 20 degrees. The helical blade does not extend to the first end of the tool as weakness can occur with the helical blade extending to the end.

Each helical blade can have a second spiral angled section extending away from the second end segment at an angle from about 1 degree to about 20 degrees. The helical blade does not extend to the second end of the tool.

The second spiral angled section can increase in radius from the second end segment towards the midpoint of the downhole tool.

Both spiral angled sections can converge on a midpoint of the downhole tool and of the central cutting section. Each spiral angled section can be formed at the same angle forming a smooth curve from one end segment of the tool to the other end segment of the downhole tool.

Each spiral angled section can extend away from the end segment, but not the end, towards a midpoint of the central cutting section.

In embodiments, each spiral angled section can extend away from the first end segment and the second end segment at an angle ranging from about 10 degrees to about 30 degrees from a plane of the first and second end segments.

In one or more embodiments, the helical blades can have more than two spiral angled sections.

The spiral angled sections can be integrally connected to each other forming a smooth continuous helical blade with great strength, easily twice the strength of other types of reamers without deforming.

In embodiments, the downhole tool can use helical blades that range in width from about 1.5 inches to about 6 inches.

In one or more embodiments, the tubular body can be a one piece integral steel component, formed from a single piece of cut steel.

In another embodiment, the helical blades can be welded to the tubular body forming the central cutting section.

Pluralities of polydiamond cutter nodes can be disposed on each spiral angled section. The polydiamond cutter nodes can be grouped in circles, organized in swirl patterns, or in another pattern. The density of the polydiamond cutter nodes in embodiments can range from about 1 per inch to about 6 per inch. In an embodiment the polydiamond cutter nodes can be aligned in rows of 2 polydiamond cutter nodes to 16 polydiamond cutter nodes. In another embodiment, the polydiamond cutter nodes can be aligned in two rows, such as several nodes in rows of 3, per spiral angled section.

In an embodiment, the polydiamond cutter nodes can be made from synthetic diamond material made by US Synthetic located in Orem, Utah. The polydiamond cutter nodes can be flat faced, dome shaped, or combinations thereof. The polydiamond cutter nodes can have a shape that is elliptical, circular, angular, or combinations thereof. The height of each polydiamond cutter node as measured from the surface of one of the spiraled angled sections can range from flush flat to about $\frac{3}{4}^{th}$ of an inch.

Spiral angled sections can be connected together to form a curved section. In one or more embodiments, the spiral angled sections can be a series of stepped sections welded together or otherwise connected. In an embodiment, each spiral angled section can have high strength carbide cutting nodes formed thereon.

The high strength carbide cutting nodes can be formed on the spiral angled section, either as a single row, double rows, triple rows, multiple rows, or in patches. The high strength carbide cutting nodes are known as "carbide inserts" in the industry. Usable high strength carbide cutting nodes can be round, elliptical, or angular. Usable high strength carbide cutting nodes can be flat faced or round faced.

In embodiments, teeth can be created on one or both edges of one or more of the spiral angled sections to enhance cutting by at least one of the helical blades.

In one or more embodiments, flute sections can be located between the helical blades. Each flute section can provide a "junk slot volume" providing an optimum drilling mud flow path and cuttings removal channel allowing "junk" from the wellbore to freely flow past the downhole tool without impeding operation. The flutes are critical for the tool to continuously operate bidirectionally. In embodiments, the flute sections can be tapered on both ends.

The helical spiral shape of the blades on the downhole tool can enable the downhole tool to slide easily in the wellbore.

In embodiments, a first connector can couple to the first end of the downhole tool to engage a bottom hole assembly component, such as a drill bit.

In embodiments, a second connector can couple to the second end of the downhole tool to engage a bottom hole assembly component, such as a tubular.

The downhole tool can use a box connection for providing quick install and removal of the tool from the drill string as the first connector, second connector, or combinations thereof.

The quick install and removal connection can engage a float assembly, or a measurement while drilling component.

In embodiments of the downhole tool, the spiral angled section can be a plurality of two or more stepped sections with high strength carbide cutting nodes disposed on each of the stepped sections. Each of the stepped sections can provide a different size outer diameter for reaming the wellbore. The stepped section outer diameters can increase by about 1 percent for each step in an embodiment.

In an embodiment, one stepped section can have a height from about 1 centimeter to about 3 centimeters different in height from an adjacent stepped section.

In one or more embodiments, the central cutting section of the downhole tool can include a cutting material with more flexibility than the base tubular, thereby enabling the downhole tool to continue in the presence of stiff rock without breaking. The downhole tool can be constructed from two different materials, each having different physical properties, the central cutting section for example, can be a softer material than the tubular surrounding the annulus.

In embodiments, the downhole tool can have a downhole tool outer diameter calculated from an outermost surface of the spiral angled section. In one or more embodiments, the downhole tool outer diameter can range from about 3 inches to about 36 inches and can have specific outer diameters of 5 and ¾ inches, 5 and ⅞ inches, 6 inches, 6 and ¾ inches, 8 and ¾ inches, 8 and ⅝ inches, 9 and ¾ inches, 9 and ⅞ inches, 10 and ⅝ inches, 12 inches, 13 and ½ inches, 16 inches, and 17 and ½ inches.

In embodiments, the downhole tool can have high strength carbide cutting nodes that are made from a tungsten carbide material, such as Casmet Supply Ltd of Penticton, British Columbia products identified as "tungsten carbide inserts". The synthetic diamond cutting material can be one such as those made by US Synthetic and referred to as "stud cutter 2184" a diamond enhanced cutting material. Casmet Supply Ltd also provides a tungsten carbide insert with diamond particles positioned on it, or a diamond impregnated metal matrix, such as US Synthetic product termed "stud cutter" with a mix of natural diamond and synthetic diamonds, or combinations of these materials.

In one or more embodiments, the helical blades can be up to 22 inches in length for a 5 and ⅞ inch diameter downhole tool. The helical blades can be longer, up to 48 inches.

The downhole tool can be installable anywhere in the bottom hole assembly or adjacent a drilling component including the drill bit.

Turning now to the Figures, FIG. 1 shows a wellbore 7 with a wellbore axis 8. A first bottom hole assembly component 42 is shown in the wellbore 7. The first bottom hole assembly component 42 can be a drill bit. A first connector 38 can engage the first bottom hole assembly component 42 and can engage the first end of a downhole tool 9.

This Figure shows a second connector 40 engaging a second bottom hole assembly component 44 as well as the second end of the downhole tool 9.

In embodiments, a central cutting section, which can sometimes be referred to as "the reamer," can run flush mounted to the drilling bit, or can be positioned several feet behind the drilling bit.

Figure 2:
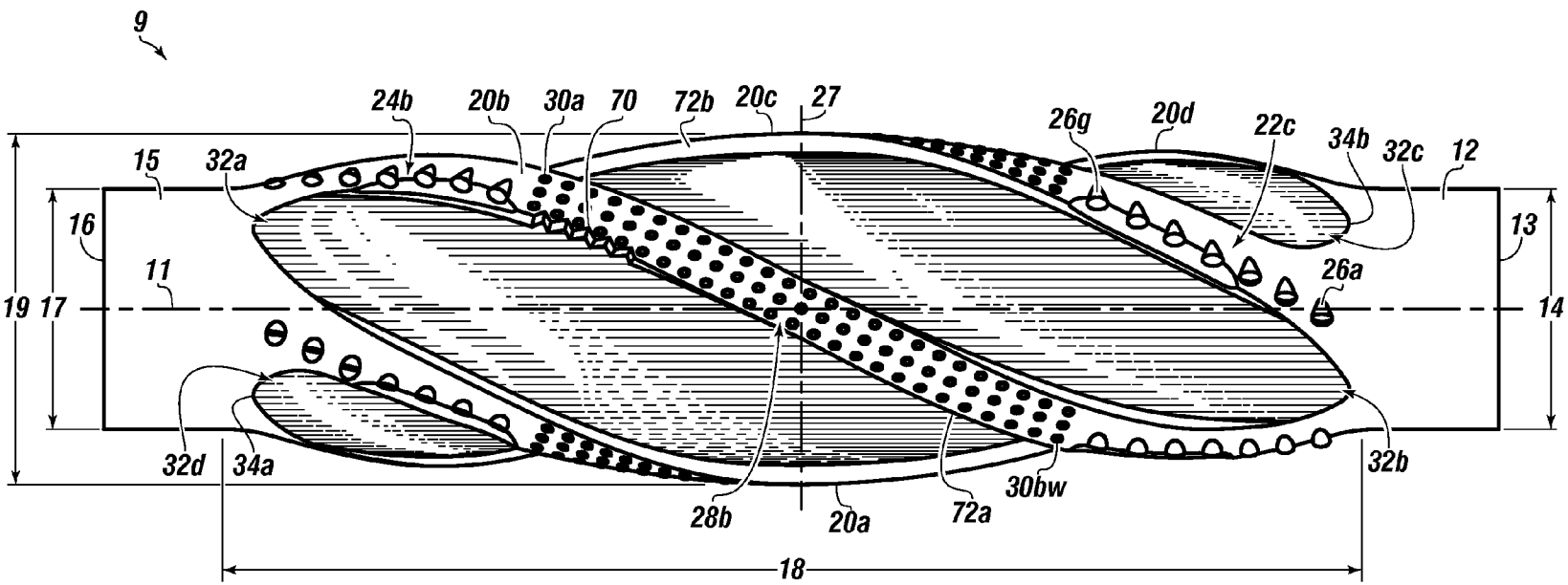
FIG. 2 is a detailed side view of an embodiment of the downhole tool.

FIG. 2 shows a detailed side view of an embodiment of the downhole tool 9 with a first end segment 12 having a first end 13 and a first end segment outer diameter 14.

The downhole tool 9 is shown with a second end segment 15 having a second end 16 and a second end segment outer diameter 17.

The downhole tool shown in this Figure can have a generally cylindrical body with a longitudinal axis 11.

A central cutting section 18 is depicted with a plurality of helical blades and is disposed between the first end segment 12 and the second end segment 15. Four helical blades 20*a*, 20*b*, 20*c*, and 20*d* are depicted.

The central cutting section 18 can have a cutting section outer diameter 19 that varies in size. The diameter of the cutting section adjacent the end segments can be less than the diameter of the cutting section at a midpoint 27. The cutting section 18 can have an outer diameter greater than each end segment outer diameter.

Flute sections 32*a*, 32*b*, 32*c* and 32*d* can be disposed between the helical blades. This embodiment shows the flute sections each having tapered ends 34*a* and 34*b*.

Each flute section can have sides sloping away from the helical blades towards a center point of the flute section. The depth of each flute section can form a trough that is equivalent in depth to the first end segment outer diameter 14 and the second end segment outer diameter 17.

A first spiral angled section 22*c* can extend from the first end segment 12. The first spiral angled section 22*c* is depicted with a single row of polydiamond cutter nodes 26*a*-26*g*.

The first spiral angled section 22*c* can increase in radius from the first end segment 12 towards a midpoint 27 of the downhole tool. The midpoint can intersect at a right angle with the longitudinal axis 11. The angle of the first spiral angle section can be 7.7 degrees +/−0.5 degrees from the longitudinal axis.

A second spiral angled section 24*b* can increase in radius from the second end segment 15 towards the midpoint 27 of the downhole tool.

This first spiral angled section 22*c* can have from 3 polydiamond cutter nodes to 10 polydiamond cutter nodes. The polydiamond cutter nodes can be positioned in a single row, in a pair of rows, or even in a circle or swirl pattern on the surface of the first spiral angled section.

Each polydiamond cutter node can have a diameter ranging from about ⅜ of an inch to about 1 inch. Each polydiamond cutter node can have a shape that is a planar surface, concave in shape, triangular, or convex in shape. Each polydiamond cutter node can be crested or braised onto each spiral angled section.

The polydiamond cutter nodes can be disposed on portions of each angled section proximate the midpoint. Alternatively, a plurality of high strength carbide cutting nodes can be disposed on portions of each spiral angled section proximate the midpoint. In still another embodiment, both polydiamond cutter nodes and high strength carbide nodes can both be used on portions of the spiral angled sections.

Each helical blade is shown having blade edges, such as blade edges 72*a* and 72*b*. In embodiments, the blade edges can be smooth, have teeth 70, or combinations thereof.

Flute sections can be formed between pairs of helical blades. Each flute section can have a flute depth that can be 0 percent to 15 percent less than either (a) the first end segment outer diameter, (b) the second end segment outer diameter, or (c) combinations of both end segment outer diameters.

A third spiral angled section 28*b* is shown with three rows of high strength carbide cutting nodes 30*a*-30*bw* having circular shapes. The third spiral angled section 28*b* can have the high strength carbide cutting nodes positioned in the section on a single row or multiple rows.

In embodiments, the high strength carbide cutting nodes can be arranged in more than three rows. It is also anticipated in an embodiment that the high strength carbide cutting nodes can be positioned in patches, with densely clustered high strength carbide cutting nodes in each patch. The high strength carbide cutting nodes can also be formed in the spiral angled section in swirl or helical patterns.

The high strength carbide cutting nodes can each have a diameter from about $\frac{1}{8}^{th}$ of an inch to about $\frac{3}{4}^{th}$ of an inch. Each high strength carbide cutting node can be flush, creating friction. The high strength carbide cutting nodes being flush can cause the helical blades to last longer since the high strength carbide cutting nodes are harder than the steel of the helical blades.

In an embodiment, the high strength carbide cutting nodes can be positioned offset to each other, not in orderly rows. In an embodiment, the density of the high strength carbide cutting nodes on each helical blade, which can be 22 inches long, can have about 180 high strength carbide cutting nodes on the helical blade.

FIG. 3 is a view from the first end of the tubular body of an embodiment of the downhole tool with first spiral angled sections extending from the tubular body.

In this Figure, the first spiral angled sections 22*a*, 22*b*, 22*c*, 22*d*, 22*e* and 22*f* of the central cutting section are shown extending from the tubular body 10.

A single row of polydiamond cutter nodes 26*a*-26*d* can be located on each of the first spiral angled sections.

In one or more embodiments, more polydiamond cutter nodes are usable on each of the first spiral angled sections. The second spiral angled section can have the same number of cutter nodes or a different number of cutter nodes, depending on the particular use intended for the cutting tool.

In an embodiment, an annulus 25 can have a 2.5 inch inner diameter annulus and the overall outer diameter of the central cutting section of the tool can be 5 and ⅞ inches. Fluid can flow through the annulus bi-directionally.

In other embodiments, the outer diameter of the central cutting section of the tool can be as large as 36 inches.

FIG. 4 is a detail of a second spiral angled section 24*b* showing a flute section 34*a* with a flute depth 36 and a plurality of polydiamond cutter nodes 26*a*-26*d*. In this Figure, the second end segment 15 is seen with a flute having flute depth 36 and the plurality of polydiamond cutter nodes 26*a*-26*b* formed on the surface of the second spiral angled section 24*b*.

FIG. 5 is a diagram of a stepped embodiment of the cutting section of the downhole tool with stepped portions 46*a*, 46*b*, 46*c*, 46*d*, and 46*e* between the first spiral angled section 22 and the second spiral angled section 24.

Each stepped portion can be oriented from about ¼ of an inch to about ½ of an inch apart. In an embodiment, each stepped portion can have different widths on each side, that is, stepped portion 46*a* can have a smaller width than stepped portion 46*b*, and stepped portion 46*b* can have a smaller width than section 46*c*. Similarly, stepped section 46*d* can have an identical width to section 46*b* or a slightly different width if desired, and stepped section 46*e* can have an identical width to section 46*a*.

Figure 6:
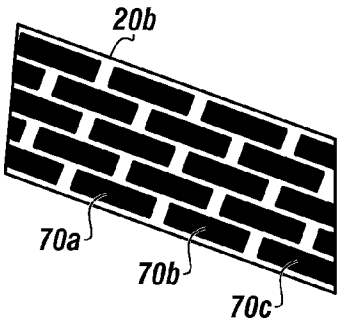
FIG. 6 is a detail of an embodiment of the downhole tool showing hardfacing coating positioned on a helical blade.

FIG. 6 is an embodiment of an application of tungsten carbide hardfacing coating 70*a*, 70*b* and 70*c* on one of the helical blades 20*b*, wherein the tungsten carbide hardfacing coating can be installed on each helical blade. In this embodiment, the tungsten carbide hardfacing coating is shown formed as a plurality of rectangular tungsten carbide inserts hardfacing surfaces. Each hardfacing surface can have a thickness of about 3 mm.

In embodiments, the tungsten carbide hardfacing coating can be annealed on each spiral angled section.

In embodiments, the tungsten carbide hardfacing coating can be a crushed tungsten carbide in a nickel bronze matrix. In embodiments, the tungsten carbide hardfacing coating can be a plurality of separated tungsten carbide cutting segments, such as 6 to 20 rectangular cutting segments, or segments formed in other shapes, such as polygonal, square, octagonal, or triangular.

Figure 7:
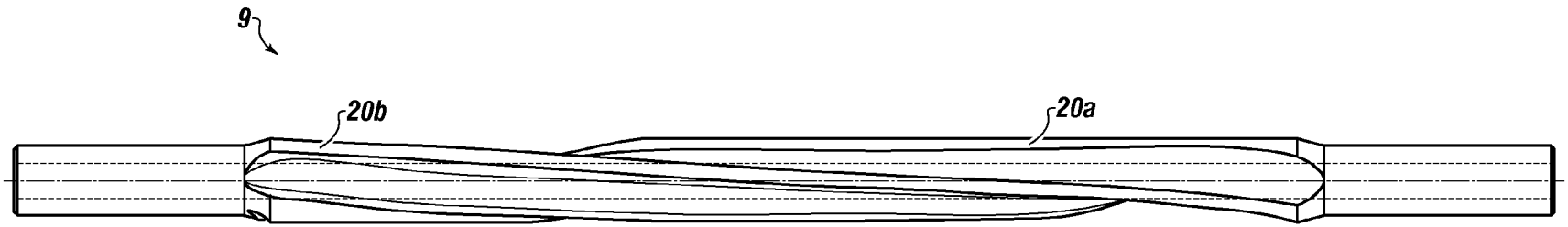
FIG. 7 depicts an embodiment of the downhole tool using only two helical blades.

FIG. 7 depicts an embodiment of the downhole tool 9 using only two helical blades 20*a* and 20*b*.

In an embodiment, each helical blade can be tempered prior to installing the polydiamond cutter nodes, high strength carbide cutting nodes, or combinations thereof. In embodiments, a surface Brinell hardness can be HB 285-341.

In one or more embodiments, the central cutting section can have a cutting section outer diameter that is greater than each end segment outer diameter and a plurality of helical blades. Each helical blade can have a first spiral angled section increasing in radius from the first end segment towards a midpoint of the downhole tool, wherein the midpoint intersects at a right angle with the longitudinal axis. Each helical blade can have a second spiral angled section increasing in radius from the second end segment towards the midpoint of the downhole tool.

In embodiments either (1) a plurality of polydiamond cutter nodes can be securely attached, such as with welding, on portions of each angled section proximate the midpoint, (2) a plurality of high strength carbide cutting nodes can be disposed on each angled section away from the midpoint, or (3) combinations of both types of nodes can be used on each of the spiral angled sections of the blades.

The downhole tool can rotate about the longitudinal axis allowing the central cutting section to ream the wellbore, such as the central cutting section can bidirectionally ream a wellbore while allowing drill fluid to flow down an annulus of the tubular body while simultaneously allowing wellbore particulates to flow up and across the flute sections. The simultaneous action is both novel and provides improved safety in the well While these embodiments have been described with emphasis on the embodiments, it should be understood that within the scope of the appended claims, the embodiments might be practiced other than as specifically described herein.

What is claimed is:

1. A downhole tool for engaging a first bottom hole assembly component and a second bottom hole assembly component for use in a wellbore having a wellbore axis, wherein the downhole tool is a tubular body comprising:

a. a first end segment having a first end and a first end segment outer diameter;

b. a second end segment having a second end and a second end segment outer diameter;

c. a longitudinal axis extending from the first end segment to the second end segment; and d. a central cutting section, wherein the central cutting section extends longitudinally along the tubular body between the first end segment and the second end segment and away from the longitudinal axis, the central cutting section comprising:

(i) a cutting section outer diameter greater than each end segment outer diameter;

(ii) a plurality of helical blades, each helical blade comprising:

1. a first spiral angled section increasing in radius from the first end segment to a midpoint of the downhole tool, wherein the midpoint intersects at a right angle with the longitudinal axis;
2. a second spiral angled section increasing in radius from the second end segment to the midpoint of the downhole tool; and
3. a plurality of polydiamond cutter nodes disposed on portions of each spiral angled section proximate the midpoint, a plurality of high strength carbide cutting nodes disposed on each spiral angled section or on portions of the spiral angled sections; and (iii) a plurality of flute sections formed between each pair of helical blades, wherein each flute section has a flute depth that is greater than 0 percent and up to 15 percent less than the first end segment outer diameter, the second end segment outer diameter, or both; and when the downhole tool rotates about the longitudinal axis, the central cutting section bidirectionally reams the wellbore while allowing drill fluid to flow down an annulus of the tubular body while simultaneously allowing wellbore particulates to flow up and across the flute sections.

2. The downhole tool of claim 1, wherein each flute section has a flute section tapered end at each end of the flute section between the helical blades.

3. The downhole tool of claim 1, wherein the first and second spiral angled sections extend away from the first and second end sections at an angle from 10 degrees to 30 degrees.

4. The downhole tool of claim 1, further comprising a first connector for engaging the first end and a second connector for engaging a second end.

5. The downhole tool of claim 1, wherein the spiral angled section comprises a plurality of stepped portions.

6. The downhole tool of claim 1, wherein each of the high strength carbide cutting nodes comprises:

a. a tungsten carbide insert;
b. a synthetic diamond cutting material;
c. a diamond enhanced cutting material;
d. a diamond impregnated metal matrix; or
e. combinations thereof.

7. The downhole tool of claim 1, wherein the central cutting section comprises from 2 helical blades to 16 helical blades.

8. The downhole tool of claim 1, wherein the cutting section outer diameter ranges from 3 inches to 36 inches.

9. The downhole tool of claim 1, wherein the downhole tool is a non-magnetic material.

10. The downhole tool of claim 1, wherein the tubular body is a one piece construction.

11. The downhole tool of claim 1, further comprising teeth disposed on a blade edge of at least one helical blade.

12. The downhole tool of claim 1, wherein the plurality of polydiamond cutter nodes comprise at least two rows of polydiamond cutter nodes on each spiral angled section.

13. The downhole tool of claim 1, wherein the plurality of polydiamond cutter nodes and the plurality of high strength carbide cutting nodes are flat faced, dome shaped, or combinations thereof.

14. The downhole tool of claim 1, wherein the plurality of polydiamond cutter nodes and the plurality of high strength carbide cutting nodes have a shape selected from the group consisting of: circular, elliptical, angular, or combinations thereof.

15. The downhole tool of claim 1, wherein each helical blade is tempered prior to installing the polydiamond cutter nodes, high strength carbide cutting nodes, or combinations thereof.

16. A downhole tool for engaging a first bottom hole assembly component and a second bottom hole assembly component for use in a wellbore having a wellbore axis, comprising:

a. a tubular body with a first end segment having a first end and a first end segment outer diameter, and a second end segment having a second end and a second end segment outer diameter; and b. a central cutting section forming a bulge, wherein the central cutting section extends longitudinally along the tubular body between the first end segment and the second end segment and away from a longitudinal axis, and wherein the central cutting section comprises:

(i) a cutting section outer diameter greater than each end segment outer diameter;

(ii) at least two helical blades, each helical blade having a length of 60 inches to 80 inches, each helical blade comprising:

1. a first spiral angled section increasing in radius from the first end segment to a midpoint of the downhole tool, wherein the midpoint intersects at a right angle with the longitudinal axis;
2. a second spiral angled section increasing in radius from the second end segment to the midpoint of the downhole tool; and
3. a tungsten carbide hardfacing coating annealed on each spiral angled section; and (iii) a plurality of flute sections formed between each pair of helical blades, wherein each flute section has a flute depth that is greater than 0 percent and up to 15 percent less than the first end segment outer diameter, the second end segment outer diameter, or both; and when the downhole tool rotates about the longitudinal axis, the central cutting section bidirectionally reams the wellbore while allowing drilling fluid to flow down an annulus of the tubular body while simultaneously allowing wellbore particulates and wellbore fluids to flow up and across the flute sections.

17. The downhole tool of claim 16, wherein the tungsten carbide hardfacing coating is a crushed tungsten carbide in a nickel bronze matrix.

18. The downhole tool of claim 17, wherein the tungsten carbide hardfacing coating is a plurality of separated tungsten carbide cutting segments formed in polygonal shapes.

* * * * *